United States Patent [19]

Randolph

[11] 4,264,071

[45] Apr. 28, 1981

[54] BOWLING BALL

[75] Inventor: John L. Randolph, Canal Fulton, Ohio

[73] Assignee: Mary E. Herwick, Barberton, Ohio

[21] Appl. No.: 12,306

[22] Filed: Feb. 15, 1979

[51] Int. Cl.[3] ..... A63B 37/10

[52] U.S. Cl. ..... 273/63 E; 273/63G

[58] Field of Search ..... 273/63 E, 63 R, 63 A, 273/63 B, 63 C, 63 D, 63 F, 63 G, DIG. 20

[56] References Cited

U.S. PATENT DOCUMENTS

| | | | |
|---|---|---|---|
| 531,103 | 12/1894 | Dokkenwadel | 273/63 R |
| 3,591,177 | 7/1971 | Skuse | 273/63 E |
| 3,865,369 | 2/1975 | Randolph . | |
| 4,099,715 | 7/1978 | Caplan | 273/63 E |
| 4,131,277 | 12/1976 | Randolph | 273/63 E X |

FOREIGN PATENT DOCUMENTS

| | | | |
|---|---|---|---|
| 320203 | 10/1929 | United Kingdom | 273/63 E |

*Primary Examiner*—George J. Marlo
*Attorney, Agent, or Firm*—Harold S. Meyer

[57] ABSTRACT

A bowling ball is made with a shell and a core of different compositions, with the core having a greater density than the shell so that the finished ball will have a predetermined weight; and the core also having a maximum dimension along an axis passing through the top of the ball where the finger holes are to be drilled, and a minimum rotational inertia around the same axis. The core is temporarily supported on a pin while the shell is cast around it, and the hole left by the pin is filled with a material of distinctive appearance to designate the top where finger holes should be drilled.

2 Claims, 6 Drawing Figures

BOWLING BALL

BACKGROUND

The balls used in various bowling games for a great many years have been made with surfaces which are not absolutely spherical, or else have been weighted in certain ways to cause them to roll in other than straight lines. In bowling with ten pins on wooden alleys, rules have been imposed, to require balls with a truly spherical surface, and to limit the permitted variations in structure, so as to minimize the effects of differences in construction of balls, and enhance the effect of skill in delivery.

Nevertheless, I have found that substantial improvements in bowling scores can be attained by apparently minor modifications of internal structure, within the limits imposed by the rules.

Thus, my prior U.S. Pat. No. 3,865,369 discloses a ball with an internal weight of such a shape that the center of mass of the ball is not at the geometric center but is displaced toward the top where the ball is held by the bowler, and so that a substatial part of the added weight is closer to the surface than to the center so that it exerts a "flywheel" effect on the ball as it rolls. Many bowlers improve their scores by using such a ball.

The ball just described has been found not to be helpful at all to certain bowlers whose delivery is superficially similar to that of the bowlers whose scores have been improved.

SUMMARY OF THE INVENTION

I have now found that many bowlers can obtain their best scores by using balls with an internal weight of exactly the opposite weight distribution from that presented in the aforesaid U.S. Pat. No. 3,865,369. This arrangement minimizes the "flywheel" effect of the weight. It also partly or completely offsets or even more than offsets the loss of weight from the top of the ball when the finger holes are drilled.

One form of such a ball is disclosed in FIG. 5 of my U.S. Pat. No. 4,131,277 dated Dec. 26, 1978, in which the weighted core approximates the shape of a bullet or slender paraboloid, with its more or less rounded tip near the top of the ball.

Other forms of the bowling ball of this invention are shown in the accompanying drawings.

THE DRAWINGS

In the accompanying drawings, the following embodiments of this invention are shown:

FIG. 1 shows the tapered bullet-like shape of weighted core presented in my U.S. Pat. No. 4,131,277.

DETAILED DESCRIPTION

The bowling balls of this invention can be made of any combination of materials within the limits of weight and consistency specified in the rules, so long as the materials have the required strength and resistance to abrasion and impact, and can be fabricated at a reasonable cost. It is now preferred to use a liquid polyester resin which can be loaded with weighting pigments and can be caused to set and harden in a simple sheet metal mold in a short time, as more fully described in my U.S. Pat. No. 4,131,277.

Figure 1:
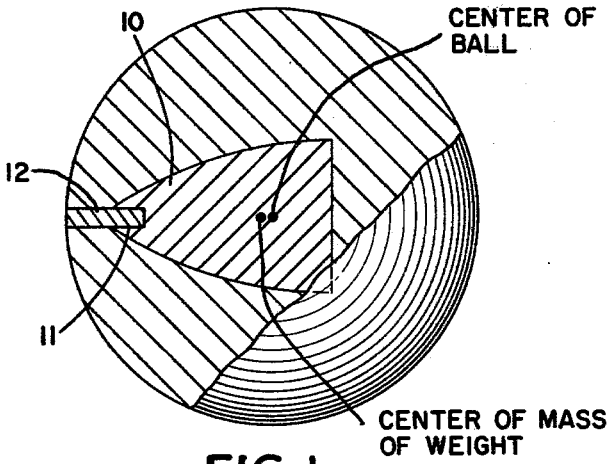

For example, the ball of FIG. 1 can be made in the manner described in my U.S. Pat. No. 4,131,277. Thus, for making the core 10, a bullet-shaped mold is provided, which may be inexpensively fabricated by spin-forming sheet metal. This mold is filled with an amount of weighting composition adequate to produce a finished ball of a particular weight. Such a composition may, for example, be a conventional liquid polyester, such as the product of the reaction of diethylene glycol with a mixture of phthalic acid (or anyhydride) with a little maleic acid (or anhydride), together with a heavy pigment such as barium sulfate or iron oxide or lead oxide in a quantity sufficient for making a ball of a particular finished weight. The mix of polyester and weighting pigment, together with a setting agent such as a small quantity of methyl ethyl ketone peroxide and a smaller quantity of cobalt naphthenate accelerator is poured into the mold and allowed to set.

The hardened core 10 is removed from the mold and a small hole 11 is drilled in its tip. A two-piece ball mold having a pin projecting inwardly from the bottom half is used to produce the remainder of the ball, by setting the core 10 with its hole 11 on the pin, and filling the remaining space in the ball mold with a suitable surfacing composition, which may be the same polyester material just described, but without the weighting pigment, or with a reduced proportion of pigment.

When the material of the ball has hardened, it is removed from the mold, and the hole formed by the pin on which the core was supported is then filled with a plug of the same or a similar composition 12. After the filling has set, the ball is finished by grinding and polishing to a truly spherical shape in the usual manner. Preferably the plug of material 12 filling the hole is of a different appearance, such as a different color or pigmentation, to indicate the top position around which the finger holes are later to be drilled.

It is evident that the amount of top weight can be varied in a very simple manner by changing the length of the pin which supports the weighted core 10, so as to change the exact location of the core, and that the total weight can be changed by using more or less weighting pigment, or by filling the mold in which core 10 is cast to a greater or less depth. Thus balls of different specifications can be produced to suit the preferances or needs of different bowlers. It is not essential that the weighted core have any particular shape, so long as its dimension along the axis of the ball (that is, along the line from the top, where the finger holes are drilled, to the center) is greater than its dimensions transverse to that axis, so that the rotational inertia of the ball, for rotation on that axis, will be reasonably small.

Nevertheless, it is presently preferred to make the core approximately bullet-shaped, as shown in FIG. 1, for several reasons. One is that molds of that shape are easily and cheaply made. Another is that the weighted cores of various total weights are easily made in molds of a single size, either by changing the amount of weighting pigment mixed with the resin, or by changing the extent to which the mold is filled, or both. Another is the psychological effect based on the fact that the bullet shape suggests motion toward a target or goal and can encourage a bowler to do his best with a ball designed specifically for him.

Experience with these balls, having "bullet" cores, has been that they do not help all bowlers, but do significantly help a considerable number of bowlers to improve their scores.

Figure 2:
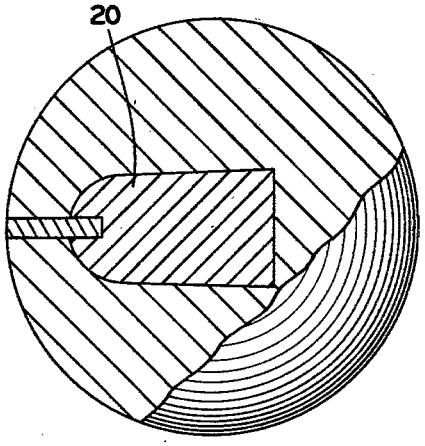
FIG. 2 shows a bullet-like weighted core with less taper and a more rounded tip.

The exact shape of the weighted cores is not critical, as long as they are of such a shape that the rotational inertia around the axis passing through the top of the ball is kept at a minimum. Thus, as shown in FIG. 2, the core 20 can have a rounded nose and only sufficient taper for easy removal from the mold in which it is cast.

Figure 3:
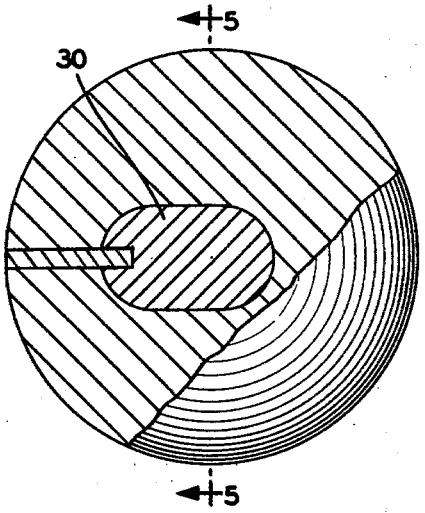
FIG. 3 shows a weighted core rounded at both ends.
Figure 5:
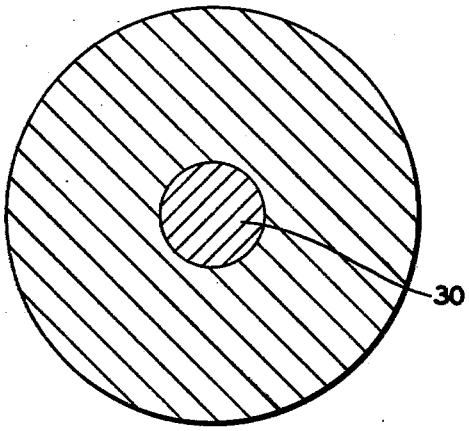
FIG. 5 is a transverse section of the ball of FIG. 3.

Moreover, if a different procedure for shaping the core is used, the weighted core 30 of FIGS. 3 and 5 can have both ends rounded, or can have a cylindrical body, or both.

Figure 4:
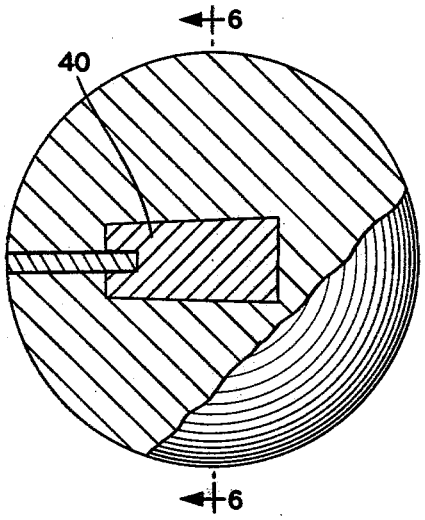
FIG. 4 shows a weighted core flattened at both ends.
Figure 6:
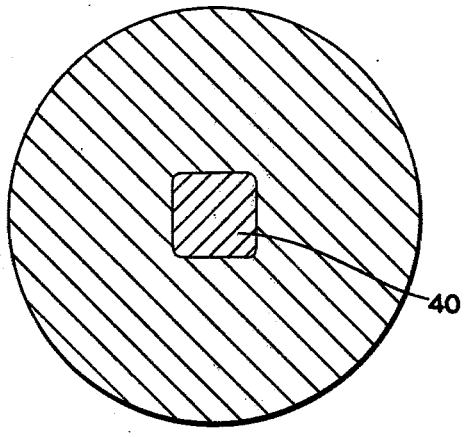
FIG. 6 is a transverse section of the ball of FIG. 4.

In addition, the weighted core can be a frustum of a cone, or of a narrow pyramid with three, four, or more sides, such as the slightly tapered core 40 with cross-sections in the shape of a polygon, as shown in FIGS. 4 and 6.

With all of these forms of the invention, these novel balls, which have the common property of a lower rotational inertia around the axis passing through the top of the ball and its center than their inertia around any other axis, have been found to permit many bowlers to increase their scores.

The reason for this improvement is believed to be that certain bowlers need balls with a minimum rotational inertia or "fly-wheel" effect around the axis passing through the top where the ball is held, so that a change in the direction of rolling toward the "pocket" is not impeded by a "fly-wheel" effect around that axis. Nevertheless, the scope of the invention should not be limited by this attempted explanation but solely by the following claims.

I claim:

1. A bowling ball comprising a spherical solid body of molded material solidly enclosing a central portion of heavier material, and a plug of recognizably different material designating the location for drilling of finger holes at the top of the ball, the central portion having a compact shape with its longest dimension in the direction toward the top of the ball such that its rotational inertia around an axis through the center of the ball and the top of the ball is less than its rotational inertia around other axes, the central portion also having its center of mass between the center of the ball and the top of the ball, and the plug extending from the top surface of the ball into the end of the central portion.

2. A bowling ball as in claim 1 in which the central portion is bullet shaped and tapered.

* * * * *